US011396760B2

(12) United States Patent
Renner et al.

(10) Patent No.: US 11,396,760 B2
(45) Date of Patent: Jul. 26, 2022

(54) TELESCOPING FLUSH HANDLE FOR LIFT AND SLIDE DOORS

(71) Applicant: Robert Renner, Boulder Creek, CA (US)

(72) Inventors: Robert Renner, Boulder Creek, CA (US); Jim Roberts, Mukwonago, WI (US); John Griep, Midvale, UT (US); Jeff Ashford, Rodney (CA)

(73) Assignee: Robert Renner, Boulder Creek, CA (US)

( * ) Notice: Subject to any disclaimer, the term of this patent is extended or adjusted under 35 U.S.C. 154(b) by 466 days.

(21) Appl. No.: 16/400,211

(22) Filed: May 1, 2019

(65) Prior Publication Data

US 2020/0347638 A1 Nov. 5, 2020

(51) Int. Cl.
*E05B 1/00* (2006.01)
*E05B 65/08* (2006.01)
(Continued)

(52) U.S. Cl.
CPC ..... *E05B 1/0092* (2013.01); *E05B 1/003* (2013.01); *E05B 1/0053* (2013.01);
(Continued)

(58) Field of Classification Search
CPC . E05B 5/00; E05B 5/003; E05B 5/006; E05B 85/10; E05B 85/103; E05B 85/107; E05B 85/14; E05B 85/16; E05B 83/40; E05B 1/003; E05B 65/0876; E05B 65/08; E05D 15/565; Y10T 74/20612;
(Continued)

(56) References Cited

U.S. PATENT DOCUMENTS 639,151 A * 12/1899 Corneil ..... E05C 17/30 292/267
1,332,193 A * 3/1920 Anderson ..... E05C 19/14 292/26
(Continued)

FOREIGN PATENT DOCUMENTS

DE 102019109639 A1 * 2/2020 ..... E05D 15/565
EP 2202371 A1 * 6/2010 ..... E05B 65/08
(Continued)

OTHER PUBLICATIONS

Energi—Fenestration Solutions. "The Lift and Slide Patio Door, by ENERGI" Oct. 13, 2016 https://www.youtube.com/watch?v=4dTemVCLZVI (Year: 2016).*

*Primary Examiner* — Christine M Mills
*Assistant Examiner* — Faria F Ahmad
(74) *Attorney, Agent, or Firm* — K&L Gates LLP

(57) ABSTRACT

The present disclosure includes a handle assembly system for use with lift and slide doors. The handle assembly can include a handle housing that can serve as a support frame for housing and securing the handle flush within a front face of the door. The handle can be pivoted out of the handle housing and extended to increase length, wherein rotating the handle allows a user to actuate the door panels in order to open and close the sliding door system. The telescoping handle can allow a user to grip the handle and provide a lever-type function to reduce the force required by the user to actuate the panel, such as to lift the panel onto or off the track.

5 Claims, 7 Drawing Sheets

(51) Int. Cl.

| | |
|---|---|
| ***E05B 85/10*** | (2014.01) |
| ***E05B 85/16*** | (2014.01) |
| ***E05B 85/14*** | (2014.01) |
| ***E05B 5/00*** | (2006.01) |
| ***E05B 83/40*** | (2014.01) |

(52) U.S. Cl.
CPC ..... *E05B 65/0876* (2013.01); *E05B 5/006* (2013.01); *E05B 83/40* (2013.01); *E05B 85/10* (2013.01); *E05B 85/103* (2013.01); *E05B 85/107* (2013.01); *E05B 85/14* (2013.01); *E05B 85/16* (2013.01); *E05Y 2900/132* (2013.01); *Y10S 292/31* (2013.01); *Y10T 292/089* (2015.04); *Y10T 292/28* (2015.04); *Y10T 292/57* (2015.04)

(58) Field of Classification Search
CPC ..... Y10T 72/20618; Y10T 292/57; Y10T 292/28; Y10T 292/31; Y10T 292/089; E05C 17/30; E05Y 2900/132
USPC ..... 70/208; 49/449, 235, 458
See application file for complete search history.

(56) References Cited

U.S. PATENT DOCUMENTS 1,819,309 A * 8/1931 Wasberg ..... E05D 15/565 16/99
1,879,369 A * 9/1932 Lute ..... E05D 15/565 16/99
1,898,582 A * 2/1933 Madland ..... E05D 15/565 16/99
2,143,127 A * 1/1939 Leonard ..... E05B 5/003 292/1
2,599,054 A * 6/1952 Gates ..... E05B 5/003 292/348
2,682,076 A * 6/1954 Christensen ..... B61D 19/005 16/99
2,721,750 A * 10/1955 Rudis ..... E05C 1/065 292/139
2,786,240 A * 3/1957 Tobiasz ..... E05D 15/565 49/425
2,874,986 A * 2/1959 Henrichs ..... E05C 1/145 292/167
3,440,682 A * 4/1969 Olander ..... E05D 15/565 16/99
3,818,636 A * 6/1974 Calais ..... E05D 15/565 49/224
4,087,883 A * 5/1978 Amdal ..... E05C 17/30 16/82
4,112,540 A * 9/1978 Wright ..... E05D 15/565 16/99
4,475,313 A * 10/1984 Governale ..... E05B 65/0811 292/101
4,634,170 A * 1/1987 Lach ..... E05C 17/30 267/64.12
4,936,049 A * 6/1990 Hansen ..... E05D 15/565 49/209
5,012,611 A * 5/1991 Hsu ..... E06B 7/18 49/225
5,172,520 A * 12/1992 Hostetler ..... E05B 65/0841 292/207
5,257,477 A * 11/1993 Kvasnes ..... E05D 15/565 16/99
5,575,321 A * 11/1996 Currier ..... E06B 9/04 160/104
5,813,710 A * 9/1998 Anderson ..... E05B 5/00 292/150
6,174,007 B1 * 1/2001 Schlack ..... E05B 5/00 292/336.3
6,668,602 B2 * 12/2003 Graham ..... E05B 1/0092 292/336.3
7,971,392 B2 * 7/2011 Seo ..... E05D 15/565 49/221
8,240,089 B2 * 8/2012 Lambertini ..... E05D 15/565 49/425
8,496,277 B2 * 7/2013 Commons ..... E05B 1/0092 292/336.3
8,533,997 B2 * 9/2013 Stoutenborough ..... E06B 3/46 49/235
9,170,598 B2 * 10/2015 Goetze ..... G05G 1/04
9,458,656 B2 * 10/2016 Mickelson ..... E05F 15/638
9,957,740 B2 * 5/2018 Goetze ..... E05B 63/06
10,597,921 B2 * 3/2020 Alban ..... E05D 15/0665
2002/0079708 A1 * 6/2002 Welsh ..... E05B 17/0025 292/57
2003/0121299 A1 * 7/2003 Graham ..... E05C 3/042 70/208
2007/0240463 A1 * 10/2007 Antonucci ..... E05B 1/0092 70/208
2011/0156411 A1 * 6/2011 Commons ..... E05B 1/0092 292/336.3
2014/0070547 A1 * 3/2014 Minter ..... E05C 19/10 292/101
2015/0167365 A1 * 6/2015 Musser ..... E05B 45/06 340/542
2015/0218860 A1 * 8/2015 Goetze ..... E05B 63/06 292/142
2015/0267443 A1 * 9/2015 McMahon ..... E05C 3/16 292/336.3
2015/0315811 A1 * 11/2015 Mao ..... E05B 5/003 292/336.3
2016/0060916 A1 * 3/2016 Hernandez ..... E05C 3/042 292/197
2017/0298650 A1 * 10/2017 Minter ..... E05B 15/0006
2021/0164260 A1 * 6/2021 Johansson ..... E05B 5/006

FOREIGN PATENT DOCUMENTS

WO WO-2007073027 A1 * 6/2007 ..... E05B 65/087
WO WO-2011141677 A1 * 11/2011 ..... E05C 9/00

* cited by examiner

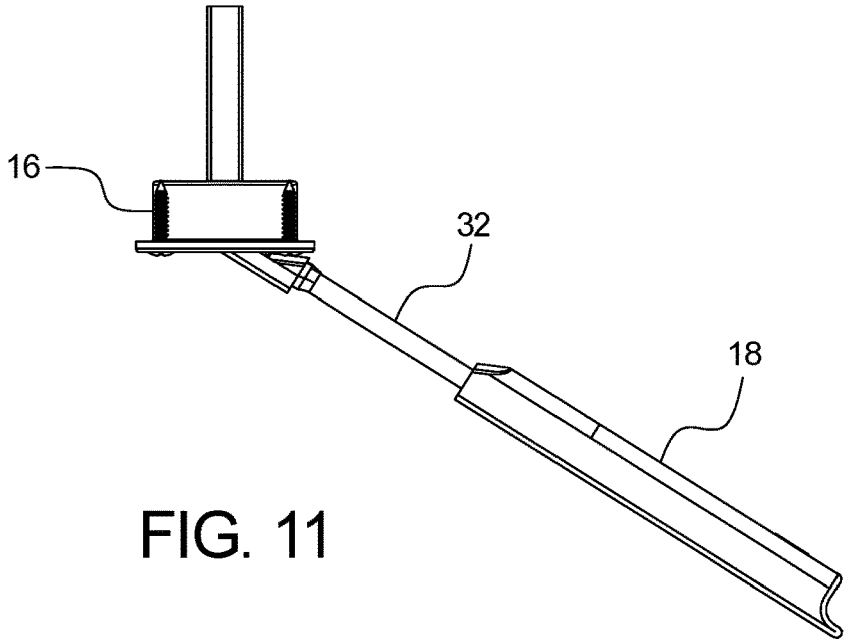
FIG. 11
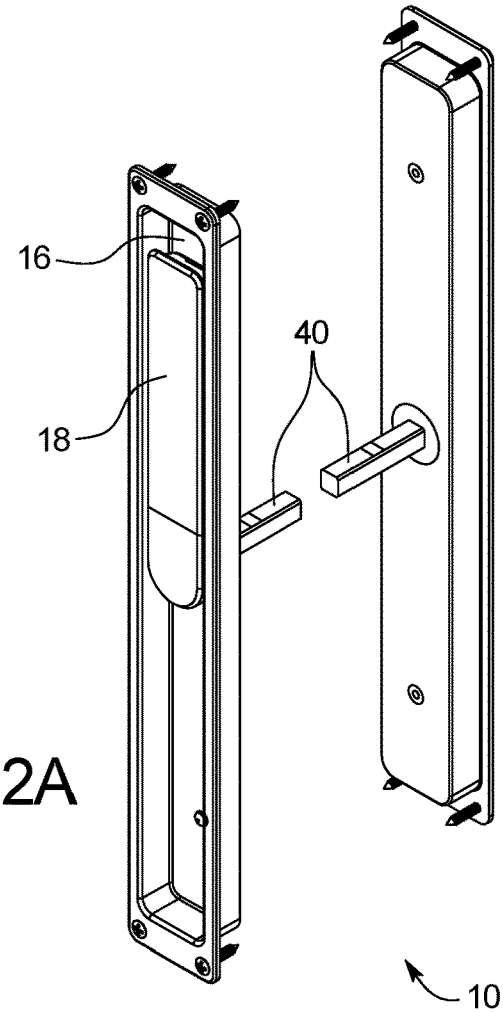
FIG. 12A
FIG. 12B

TELESCOPING FLUSH HANDLE FOR LIFT AND SLIDE DOORS

CROSS-REFERENCE TO RELATED APPLICATIONS

This application incorporates by reference and claims the benefit of priority to U.S. Provisional Application 62/665,675 filed on May 2, 2018.

BACKGROUND OF THE INVENTION

The present subject matter relates generally to sliding doors and, more particularly, to a telescoping handle that may be stored substantially flush with a door adapted to lift and slide such that the handle is out of the way while still being connected to the door.

A lift and slide door operates similar to a standard sliding door except it utilizes a roller system that allows the door panels to be lifted vertically above a track, so that the panels roll smoothly and quietly for opening and closing. As a result, a lift and slide door can efficiently divide and/or unify interior spaces of a house with exterior spaces of the house. A lift and slide door can also be utilized to divide interior spaces, replace traditional garage doors, among other applications.

Unlike traditional patio and sliding doors, lift and slide doors are more aesthetically pleasing as they may be completely hidden from view. For example, lift and slide doors allow the homeowner to open up an entire wall of the house to the outside such that the view is unobstructed as the door panels are hidden (i.e., the panels can either nest behind one another and stored to one side or disappear completely from view by being positioned inside an exterior or interior wall cavity). Lift and slide doors are commonly being used in warm climates and coastal areas to integrate the interior of the house with a sun room or rooms with an ocean view or the like. Not only do lift and slide doors allow for spectacular views of the surroundings, but they are being used to easily integrate a garden, balcony or surrounding areas with the interior of the house in order to provide the benefits of natural light into the home.

Advantageously, lift and slide doors maximize valuable living space while providing superior weather resistance properties. Namely, lift and slide doors provide superior sealing, which increases energy efficiency and, in turn, decreases heating and cooling costs. Finally, lift and slide doors are versatile as they may come in a variety of sizes, styles, panel configurations, materials, colors and other options to accommodate a particular homeowner's desires.

A common type of lift and slide door system includes a plurality of door panels, which may be stored to one side or "pocketed" inside an interior and/or exterior wall cavity when desired. The system uses an interlocking mechanism to couple the panels together so that the entire system opens and closes on stainless steel rollers on a track system. Specifically, the lift and slide door sits on grooved rollers that carry the door along a track in the floor. When locked, the rollers retract and the lift and slide door eases down, compressing a sill gasket on each side of the track. Simultaneously, wedge-shaped locking pins or hook type locking pins pull the door to one side, compressing the gaskets on each side. Further, the pins engage in the jamb at multiple points along the leading edge of the locking panel for providing a secure connection. Once open, the door may be lowered at any position and secured by moving the handle up.

Generally, a handle is used with a lift and slide door in order to unlock the door, move the door into a desired position and then lower the door once it is in the desired position. The handle typically protrudes from the door so an operator can grasp the handle in order to move, lower, and/or lock the door. One significant limitation associated with this type of handle is its protruding nature, which creates certain disadvantages. For example, the handle is not hidden from view, so it creates aesthetic issues. As the handle is not flush with door, it can be bumped into by persons or the handle may catch on clothing items or articles of furniture being moved into the room.

In addition, when multiple panels in a lift and slide door system roll parallel to another, the protruding handle on the door's stile prohibits the same doors to bypass one another. This limitation of not being able to bypass one another requires a deeper wall cavity for storage when the panels are nested in a wall cavity. Since the door panels are stopped by the protruding nature of the handles on opposite door, a deeper wall cavity is required because the doors have to be staggered in the wall cavity. Consequently, the deeper wall cavity takes up valuable living space in this arrangement. In addition, the protruding handles prevent the door panels from lining up flush with each other causing a displeasing stepped appearance to the entire door system.

In order to address these limitations associated with the handle not being flush with the lift and slide door, the handle may be removable from the door. However, this creates other problems, such as requiring an additional step to remove the handle and then reattach the handle when the door is to be moved. Furthermore, the inconvenience associated with attaching and removing the handle may be further complicated if the handle is misplaced or lost, which is not only time-consuming but expensive if the handle must be replaced. Moreover, removable handles can be accidentally dropped when assembling or disassembling causing damage to the floor and/or the user.

Accordingly, a need is identified for a handle for a lift and slide door, which may be stored substantially flush with the door such that it is out of the way while still being connected to the door while maximizing living space.

BRIEF SUMMARY OF THE INVENTION

The present disclosure provides a telescoping handle mounted flush to the door stile allowing the lift and slide doors to be pocketed and/or aligned with a flush edge panel appearance. The telescoping handle provides leverage to operate the gear in lifting 880 pound doors.

An advantage of the present system is providing a telescoping handle that can extend to a greater length to allow for more leverage when operating the handle to better control the movement of the doors. Further, because the handle is telescoping, the compressed handle has a minimal footprint flush within the door.

An advantage of the present system is providing a handle footprint that does not cause damage to the door frame or other door panels.

A further advantage of the present system is providing a spindle that can be scored to indicate length points at which the spindle can be trimmed for use with various door thicknesses.

Another advantage of the present system is that the handle can be made of stainless steel, aluminum, and/or brass. The handle can be made of corrosion resistant material.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

FIGS. 1A-1B illustrate the lift and slide doors including the disclosed telescopic handle. FIG. 1C illustrates the handle flush within a front face of the door. FIG. 1D illustrates extending the handle and rotating the handle to manipulate the placement of the door.

FIG. 11 is a top view of the extended handle pivoted away from the handle housing.

FIGS. 12A-12B are an exploded view of an example of the handle assembly.

DETAILED DESCRIPTION OF THE INVENTION

The present disclosure includes a handle assembly system for use with lift and slide doors. The handle assembly can include a handle housing that can serve as a support frame for housing and securing the handle flush within a front face of the door. The handle can be pivoted out of the handle housing and extended to increase length, wherein rotating the handle allows a user to actuate the door panels in order to open and close the sliding door system. The telescoping handle can allow a user to grip the handle and provide a lever-type function to reduce the force required by the user to actuate the panel, such as to lift the panel onto or off (e.g., up or down) the track. Specifically, the rotation actuates a typical mechanism in the lift and slide door panel to raise the panel off the ground and move a bearing system in contact with an exposed bead of a track in the floor. The user can then use the handle and apply force in the direction he or she desires the door to be moved.

The handle system is contemplated to be used with lift and slide door assemblies, but can be used with substantially any type of door. The handle can be nested into a recess (e.g., handle housing) when not in use, which allows the handle to be substantially flush with a front surface of the door when not in use. By providing a flush handle, the panel can be easily stored, such as in a pocket structure of a door frame. Further panels may be stacked against other panels or another structure without the handle interfering with the position of the panel.

Figure 1A:
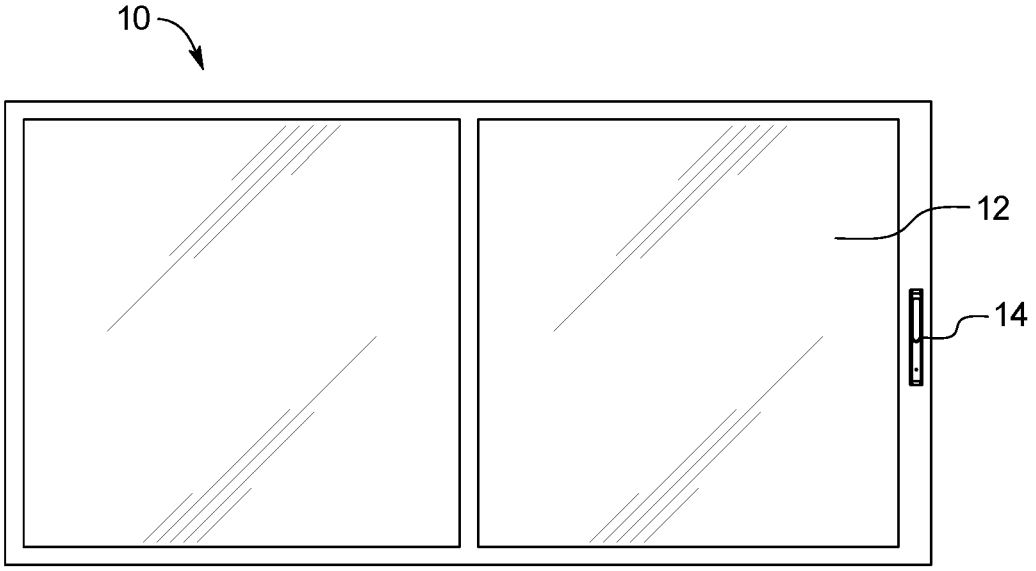
FIGS. 1A-1D is a schematic of an example of the system disclosed herein.
Figure 1B:
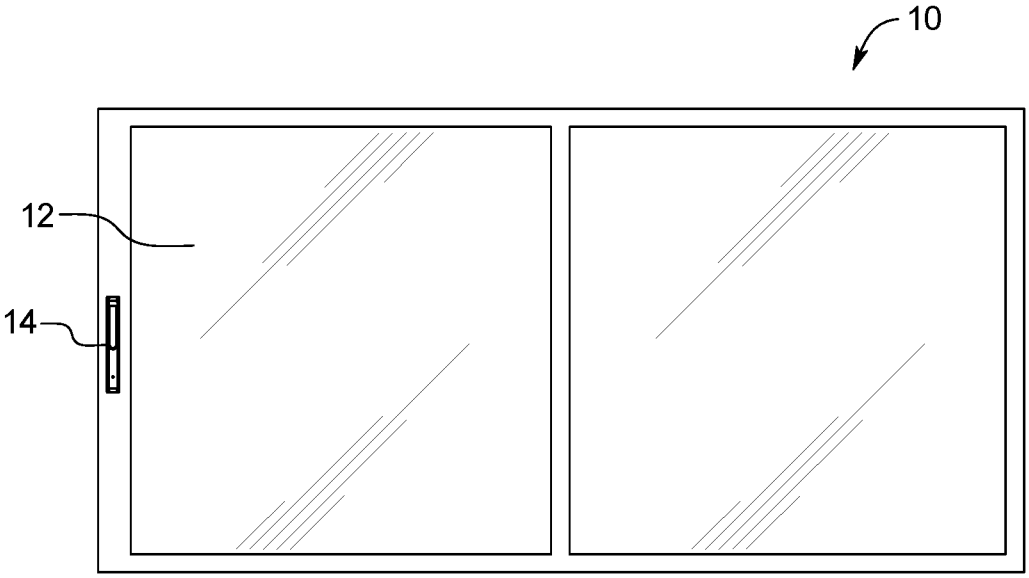
Figure 1D:
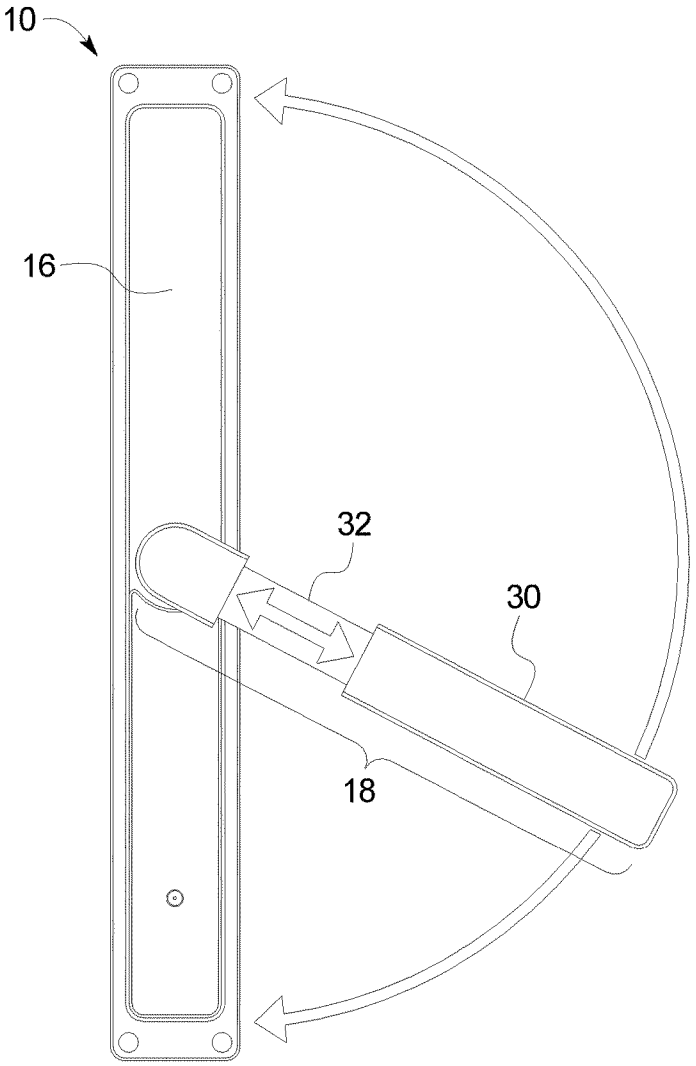
Figure 1C:
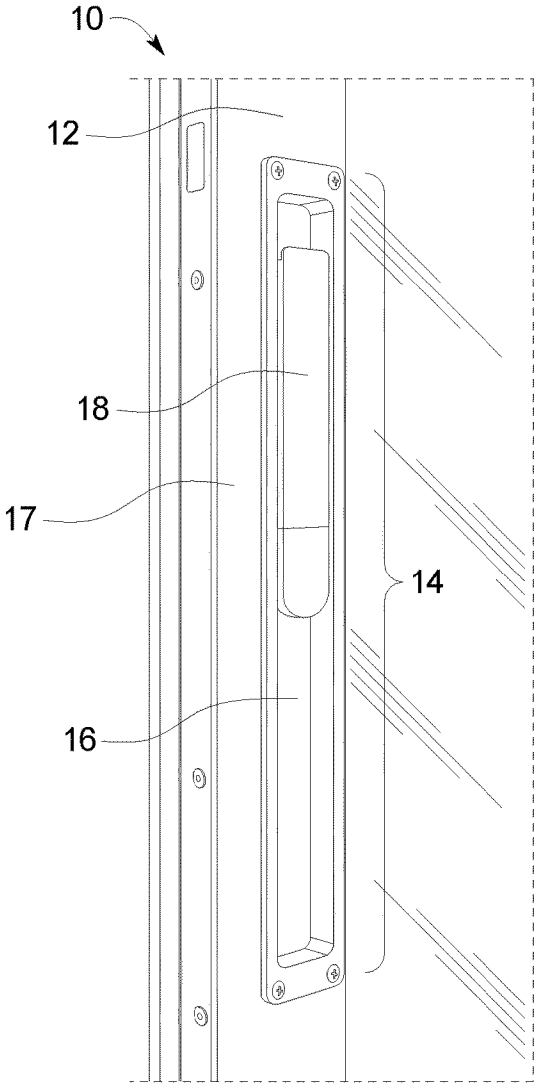

FIGS. 1A-1D is a schematic of an example of the system 10 disclosed herein. As shown in FIGS. 1A-1B, lift and slide doors 12 including the disclosed telescopic handle 18. FIG. 1C illustrates the handle 18 flush within a handle housing 16 in the front face 17 of the door 12. FIG. 1D illustrates pivoting the handle 18 out of the handle housing 16 and extending the handle 18 and rotating the handle to manipulate the placement of the door.

The handle housing 14 can be positioned on a face of the door 12, wherein the handle housing 14 can be a carved out (e.g., recessed) void within the door 12 such that the handle 18 sits within the handle housing 16, wherein the handle 18 sits flush with the surface of the door 12. In an example, the handle housing 16 can have a footprint with the dimensions of 15¼" by 2".

Figure 2B:
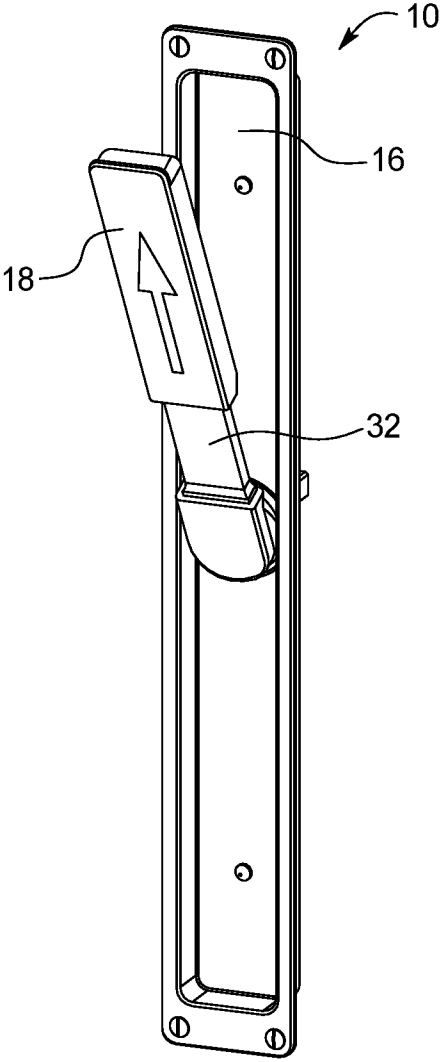
FIGS. 2A-2B are perspective views of examples of pulling out the handle (both compact and expanded) from the handle housing and extending the handle to increase its length.
Figure 2A:
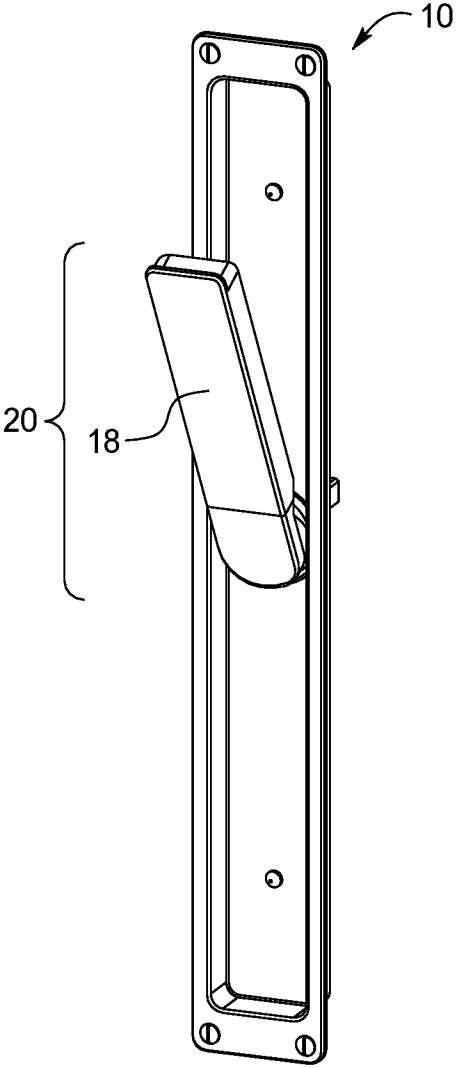

FIGS. 2A-2B are perspective views of an example of pulling out the handle 18 from the handle housing 16 and extending the handle 18 to increase its length. In an example, first the handle 18 can be pivoted from the first end 24 of the handle such that the second end 26 of the handle 18 extends out of the handle housing 16, wherein the first end 24 of the handle 18 remains in the handle housing 16. The angle (as indicated as θ in FIG. 11) at which the first end 24 of the handle 18 pivots from the handle housing 16 and/or surface of the door 12 can be between, and including, 5-30 degrees.

Once the handle 18 is pivoted away from the handle housing 16, the handle 18 can be expanded in length. For example, the handle 18 can be a telescoping handle such that once the handle 18 is pivoted away from the handle housing 16, the telescoping handle can be extended (to form an extended handle) such that the length of the handle 18 can increase by sliding a first portion 30 of the handle 18 from the second portion 32 of the handle 18. FIG. 11 is a top view of the handle 18 pivoted away from the handle housing 16, wherein the handle 18 has been rotated 90 degrees from the starting position. The handle 18 can pivot out of the handle housing 16, wherein an angle is formed between the handle housing and/or front surface of the door panel 12. The angle is maintained as the handle 18 is expanded, wherein the first portion 30 and second portion 32 are co-linear.

Figure 3:
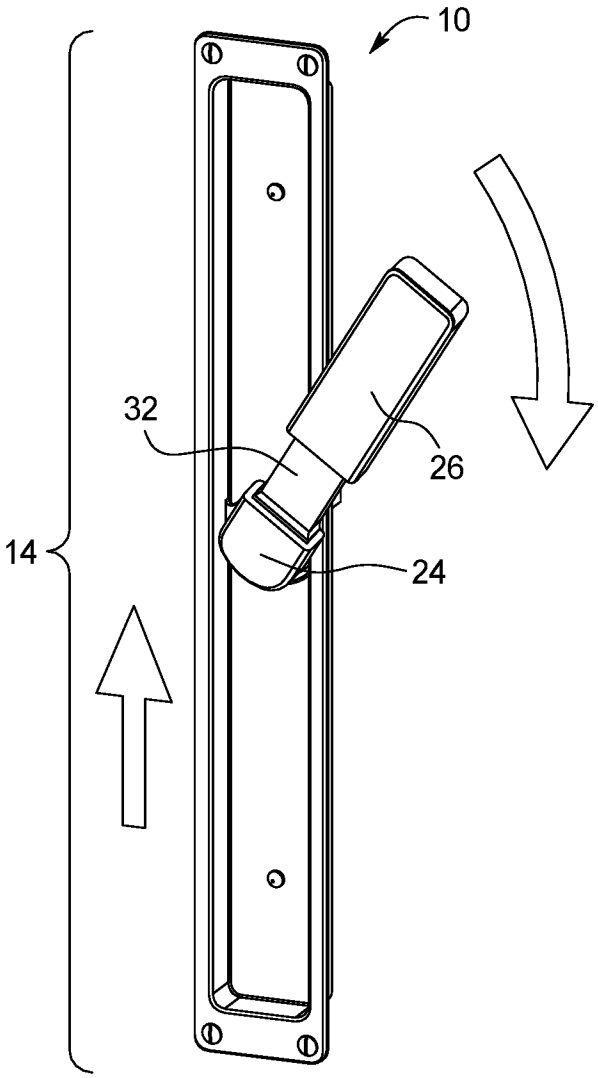
FIGS. 3-5 are perspective views of an example of rotating the handle 180 degrees from the first, starting position.
Figure 6B:
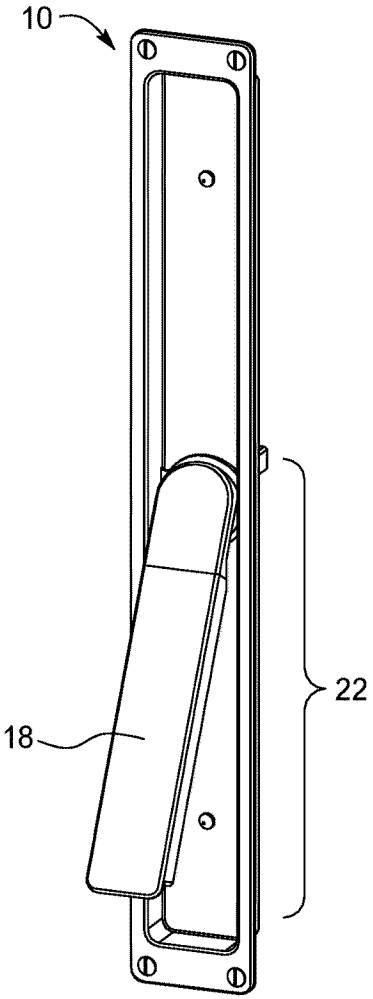
FIGS. 6A-6B are perspective views of examples of the handle (both compact and expanded) at the second position, 180 degrees from the first position, wherein when the handle is at the second position, the door is lifted and free to open or close.
Figure 6A:
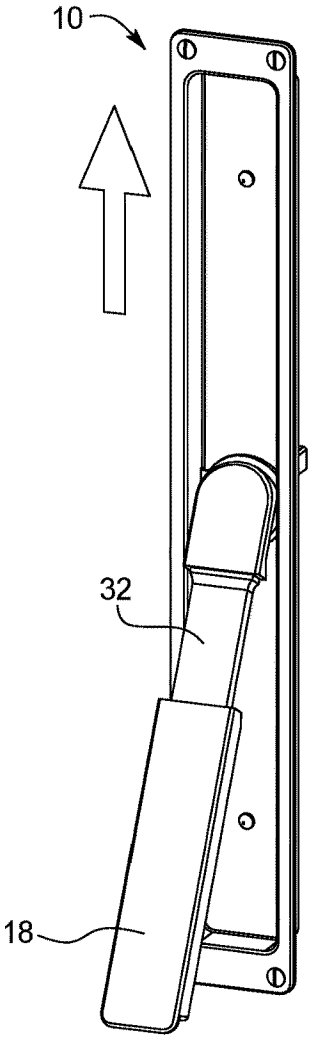
Figure 5:
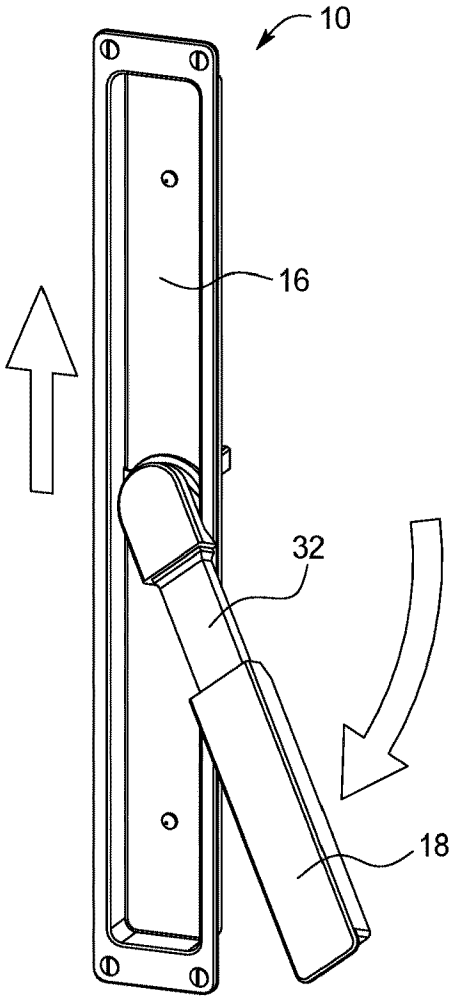
Figure 4:
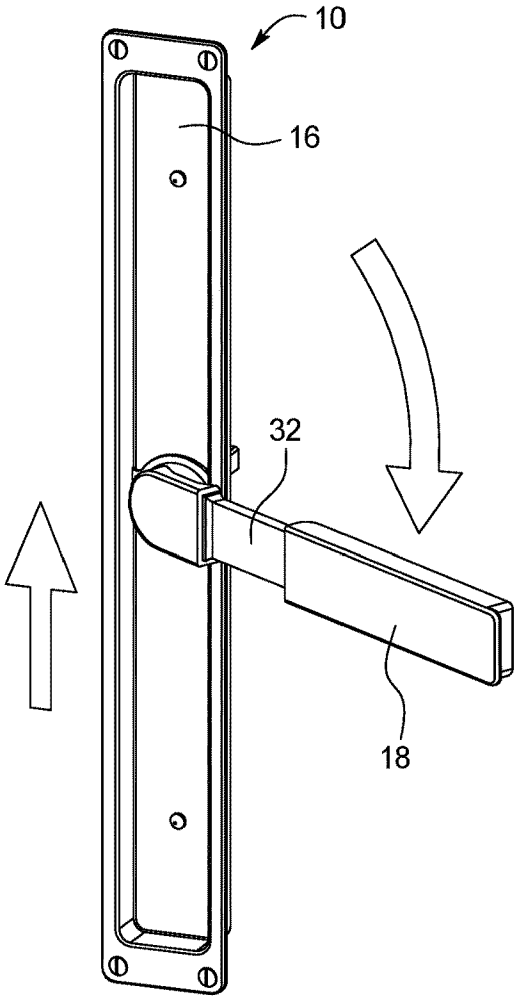
Figure 8:
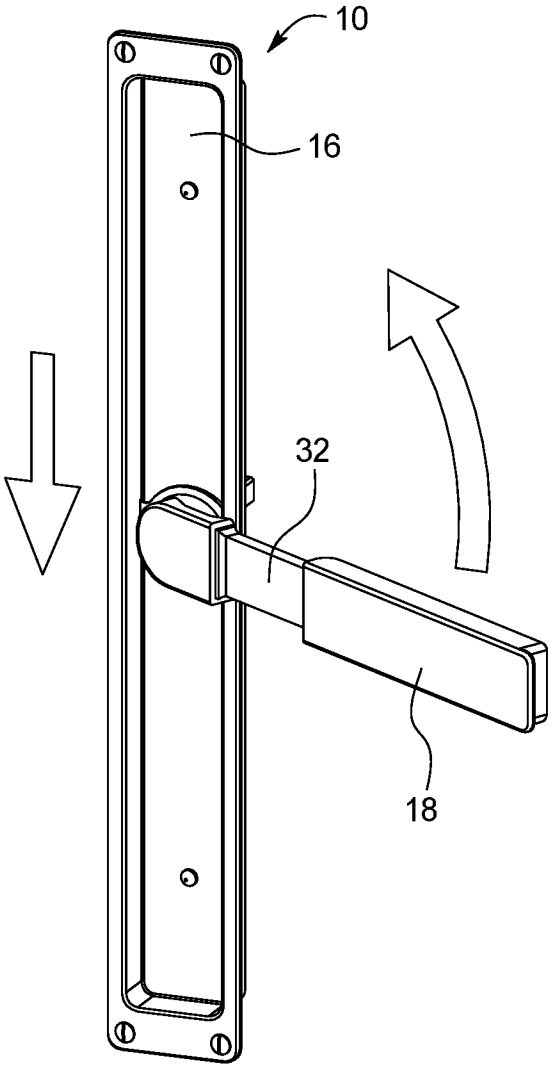
FIGS. 7-9 are perspective views of an example of the handle rotating from the second position back to the first position.
Figure 7:
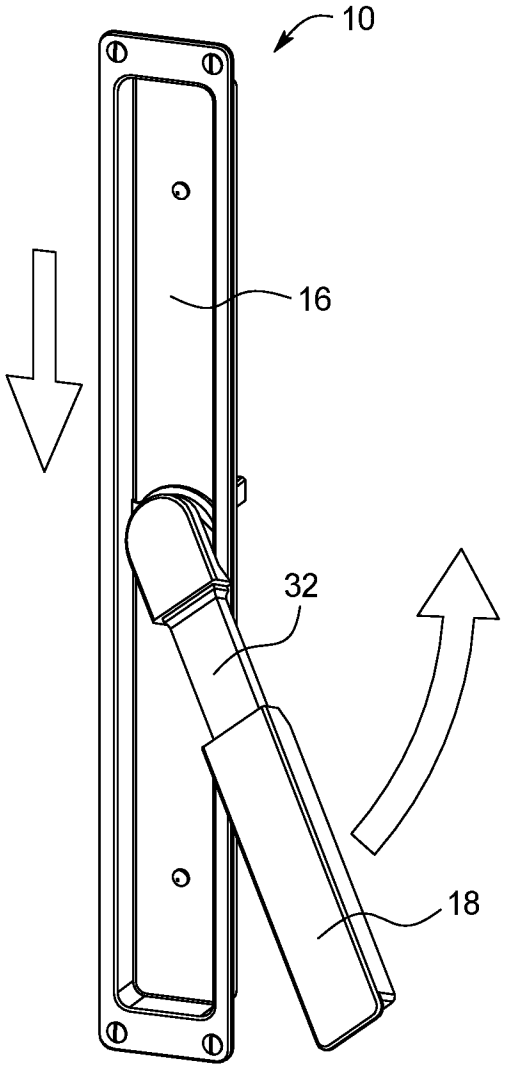
Figure 10B:
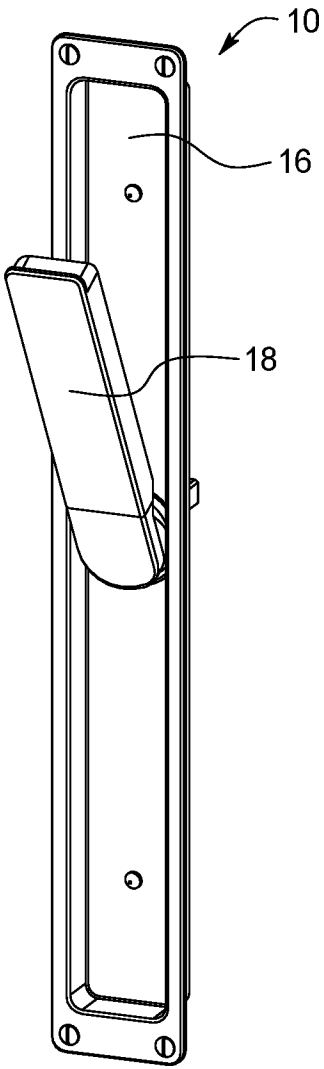
FIGS. 10A-10B are perspective views of an example of the handle (both compact and expanded) back in the first position.
Figure 10A:
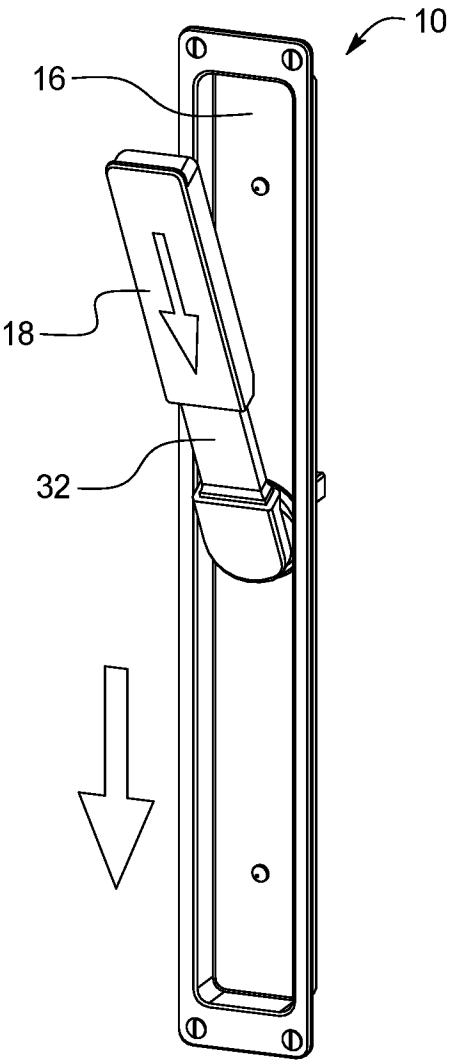
Figure 9:
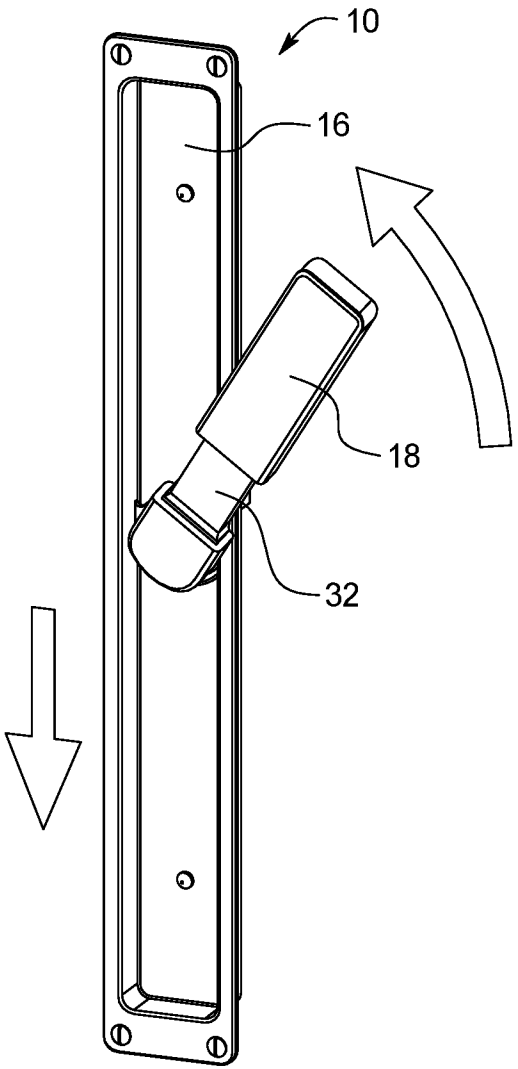

FIGS. 3-5 are perspective views of an example of rotating the extended handle 180 degrees from the first position 20, starting position (e.g., 12 o'clock). FIGS. 6A-6B are perspective views of an example of the handle at the second position 22 (e.g., 6 o'clock), 180 degrees from the first position 20, wherein when the handle 18 is at the second position 22, the door 12 is lifted and free to open or close. FIGS. 7-10B are perspective views of an example of the handle 18 rotating from the second position 22 back to the first position 20.

The handle can include at least one score mark. For example, the handle can include score marks for a 57 mm (2.25") and 68 mm (2.677") sash thicknesses with locks that are centered in the stile related to the interior and exterior surfaces of the panel. For doors with locks off set from center, the cut length or hole depth can be predetermined. For example, for a centered lock design, the spindle can be scored for 57 mm panel thickness and/or scored for 68 mm panel thickness. For an off-center lock design, the spindle 40 (see FIGS. 12A-12B) can be scored for 65 mm for maximum offset, and 39 mm for minimum offset. Alternatively, a clearance hole can be drilled for an extra spindle length to avoid cutting the spindle 40.

The handle 18 rotation can operate to interface with a mechanism in the door panel 12 to raise or lower the door 12 and engage or disengage the bearing system in the door 12 with the tracks. Once the door panel 12 is lifted and the bearing system engages the track the user can move the door 12 along the length of the track. If an adjacent door panel 12 needs to bypass another door panel 12, the handle 18 can be pushed back into the cavity of the outer frame. In the nested position, the latch spring and/or compression spring biases the latch towards a catch or groove defined in the hub to lock the handle in position.

If a door panel 12 needs to be set on the floor, e.g., when the opening is needs to be closed and sealed to prevent outside weather elements (e.g., rain, wind) from entering the structure, the handle can be pulled out at a finger grip at the end of the sliding handle to release the handle 18 and the handle 18 can be rotated (e.g., 180 degrees in the opposite direction to an original position), thus removing the bearing system from the track and lowering the door panel to the floor. The handle 18 can then be pushed back into a nested position within the outer frame flush with the surface of the panel 12 for a smooth aesthetic appearance.

The lever assembly allows the handle 18 to be substantially flush with the outer surface of the door panel 12 when not in use. The flush orientation of the handle 18 allows the door panels to slide past one another and also allows the panels to be stored against each other and/or within a wall pocket. For example, the door panels 12 are typically stored within a cavity defined within a structure, such as the frame of the door opening. Because the handle 18 is flush with the face of the door panel 12, the door panel 12 can slide into the pocket of the door frame and the handle 18 can not protrude past the edge of the door frame. The handle 18 may be used with door panels 12 in lift and slide door assemblies and, with the related linkage, provides sufficient leverage to allow a user to engage the lifting mechanisms in the panels that may often weigh several hundred pounds each. Conventional lift and slide handles 18 extend from the door panel surface to provide for the lever action to offset the weight of the door panels 12 and are removable once the panels have been lifted onto the tracks in order for the door panels 12 to slide past one another.

The present disclosure includes an installation method that can include routing the door. The method can include ensuring the lift slide lock is installed in the door with the wheels in the up and locked position. The spindle length requirement can be determined and the spindle can be cut to the determined length. The handle can be inserted into the assembly with the operating handle in the upward position (12 o'clock). A pilot hole can be drilled using a 1/16" diameter drill bit, followed by mounting the handle with the included M4×20 mm mounting screws.

The present system can be used for slide doors of 37.5 mm backset. A 2¼" minimum sash thickness for surface mount (drive gear centered), as well as 2½" minimum sash thickness for recess mount (drive gear centered). The system can be used with any suitable doors, including, but not limited to, aluminum and/or steel doors with the 27.5 mm backset.

The handle can be made of any suitable material. In an example, the handle 18 is made of stainless steel, e.g., 304 grade. The handle 18 can have any suitable finish, such as, PVD protected Satin Stainless Steel, Satin Brass, and Expresso finishes.

It should be noted that various changes and modifications to the embodiments described herein will be apparent to those skilled in the art. Such changes and modifications may be made without departing from the spirit and scope of the present invention and without diminishing its attendant advantages. For example, various embodiments of the systems and methods may be provided based on various combinations of the features and functions from the subject matter provided herein.

We claim:

1. A handle assembly for use in lift and slide door systems, the handle assembly comprising:

a handle housing configured to be positioned within a portion of a front surface of a door panel; and a telescoping handle including a first end and a second end, wherein the first end is pivotably connected to the handle housing at a pivot point, wherein the telescoping handle pivots between a handle storage position and a handle operable position;

wherein, when the telescoping handle is in the handle storage position, both the first end and the second end of the telescoping handle are positioned within the handle housing;

wherein, the telescoping handle is placed in the handle operable position from the handle storage position by first pivoting the second end out of the handle housing around the pivot point to place the telescoping handle an angle of between 5 and 30 degrees between an axis of the telescoping handle and the front surface of the door panel and then lengthening a distance between the first end and the second end by extending the telescoping handle to a lengthened configuration; and wherein, when the telescoping handle is in the handle storage position, the telescoping handle prevents the door from sliding open;

wherein, when the telescoping handle is in the handle operable position, the telescoping handle enables the door to slide open.

2. The handle assembly of claim 1, wherein the telescoping handle includes a first portion and a second portion, wherein, when the telescoping handle is in the handle storage position, the first portion and the second portion are adjacent, wherein, when the telescoping handle is in the handle operable position, the first portion slides along the second portion to linearly increase the length of the telescoping handle.

3. The handle assembly of claim 1, wherein when the telescoping handle is in the handle storage position, the door is locked.

4. The handle assembly of claim 1, wherein when the telescoping handle is in the handle operable position, the door is unlocked.

5. The handle assembly of claim 1, wherein the handle housing has dimensions on the front surface of the door panel of 15¼ in by 2 in.

* * * * *